US007626141B2

(12) United States Patent
Rodriguez-Medina et al.

(10) Patent No.: US 7,626,141 B2
(45) Date of Patent: Dec. 1, 2009

(54) MOUNTING DEVICE GAS IGNITER

(75) Inventors: Miguel A. Rodriguez-Medina, Mayaguez, PR (US); Angel R. Martinez-Ocasio, Sabana Grande, PR (US)

(73) Assignee: Surface Igniter LLC, Chagrin Falls, OH (US)

( * ) Notice: Subject to any disclaimer, the term of this patent is extended or adjusted under 35 U.S.C. 154(b) by 406 days.

(21) Appl. No.: 11/384,122

(22) Filed: Mar. 20, 2006

(65) Prior Publication Data

US 2007/0215591 A1 Sep. 20, 2007

(51) Int. Cl.
*F23Q 7/00* (2006.01)
*H01T 13/20* (2006.01)

(52) U.S. Cl. ..... 219/260; 313/143 R

(58) Field of Classification Search ..... 219/260, 219/261, 262, 263, 264, 265, 266, 267, 268, 219/269, 270, 141; 313/141
See application file for complete search history.

(56) References Cited

U.S. PATENT DOCUMENTS 3,372,305 A 3/1968 Mikulec
3,842,319 A 10/1974 Perl
4,029,936 A 6/1977 Schweitzer
4,058,789 A 11/1977 Bavisotto
5,856,651 A 1/1999 Shaffer
6,720,530 B2 * 4/2004 Taniguchi et al. ..... 219/270
6,737,612 B2 * 5/2004 Taniguchi et al. ..... 219/270
7,005,612 B2 2/2006 Han
2002/0050775 A1 * 5/2002 Hori ..... 313/141
2004/0206856 A1 * 10/2004 Cordero et al. ..... 248/70

OTHER PUBLICATIONS

International Search Report for PCT/US07/03458.

* cited by examiner

*Primary Examiner*—Daniel L Robinson
(74) *Attorney, Agent, or Firm*—Fay Sharpe LLP

(57) ABSTRACT

A gas igniter comprising an heating element and a mounting bushing. The heating element includes an elongated high resistance cylindrical nose coil and two rear terminal elements electrically insulated from each other, and an input lead connected to each of the elements. The bushing is formed from a generally rigid electrically insulating material for mounting the heating element onto an external support structure. A passage in the bushing receives the heating element with a gap between the heating element and the passage, an adhesive mass in the gap secures the heating element into the bushing and a sheet metal mounting bracket is integrally formed with the insulating material of the bushing.

12 Claims, 7 Drawing Sheets

MOUNTING DEVICE GAS IGNITER

The present invention relates to a gas igniter of the type used for gas appliances and more particularly to a novel mounting device for a gas igniter.

INCORPORATION BY REFERENCE

Many patents disclose an igniter with an elongated cylindrical heating elements for use in a gas appliance to selectively ignite the gas as it is first turned on. This technology is well developed and disclosed in many existing patents, such as Perl U.S. Pat. No. 3,842,319; Schweitzer U.S. Pat. No. 4,029,936; Bavisotto U.S. Pat. No. 4,058,789 and Shaffer U.S. Pat. No. 5,856,651. These representative gas igniter patents are incorporated by reference herein as background information and as disclosure of the technology to which the present invention is directed. More specifically, the advancement realized by the present invention relates to a mounting device for the gas igniter. Such devices are disclosed in U.S. Publication No. 2004/0206856 incorporated by reference herein to represent additional background of the present invention.

BACKGROUND OF INVENTION

Cylindrical gas igniters are used to ignite a flammable gas for use in connection with all types of heating appliances. It is well known that the gas igniter must be supported relative to a remote external support structure to be in the proper position for efficient ignition of the gaseous material. To support a gas igniter, a bracket securely fastens an insulator housing of the gas igniter to a support structure in the appliances. The bracket is capable of withstanding the variable environment. Such gas igniters are used to ignite flammable gas, which in turn is used to provide the heat for the heating apparatus or appliances. The support bracket is subjected to high temperatures created by the burning gas. In addition, the gas igniter and bracket are both subjected to intermittent vibrations. It is, therefore, beneficial for the bracket to be rigid and capable of absorbing shock, while maintaining the proper orientation of the heating element of the gas igniter. Due to the adverse conditions in which the igniter and bracket are used, it is common practice to produce the bracket from a thin sheet metal corrosion resistant metal.

A mounting device or bracket for a gas igniter solving the various technical problems associated with a gas igniter is disclosed in U.S. Publication No. 2004/0206856. This type of surrounding bracket has been very successful in practice; however, it is relatively expensive and requires a number of formed sheet metal components and a multitude of assembly operations. Thus, there is a commercial need for a mounting device to be used with a cylindrical gas igniter, which device accomplishes the objectives of the bracket shown in the recent publication, but involves use of less metal, has a lower cost and requires fewer assembly operations.

The invention involves a mounting device for a gas igniter which performs the necessary functions for mounting the gas igniter to an external structure, which igniter requires substantially less sheet metal, is easy to assemble and, therefore, involves substantially less cost without sacrificing its mechanical effectiveness. The invention is integrally forming of the sheet metal mounting bracket with the ceramic support bushing of the heating element so there is no need for assembly of the bracket onto the heating element or bushing, either at the manufacturing facility or in the field, as required by the bracket disclosed in U.S. Publication No. 2004/0206856.

In accordance with the present invention there is provided a gas igniter of the type comprising a heating element including an elongated, high resistance cylindrical nose coil with a central axis and two rear terminal elements electrically insulated from each other. The terminal elements each have a given axial length to thereby define a generally rigid, generally cylindrical support section and an input lead is connected to each of the elements and extends rearwardly from the support section. A bushing is formed from a generally rigid, electrically insulation material and mounts the heating element onto an external support structure. In accordance with the invention the bushing includes a passage with an opened front end for receiving the support section of the heating element with a gap between the support section and the passage. An adhesive mass in the gap secures the heating element into the bushing and a sheet metal mounting bracket is integrally formed with the insulation material of the bushing. Consequently, the bracket extends from the bushing and has a connector portion fixedly attachable to the external support structure. In the preferred embodiment, the adhesive mass integrates the sheet metal bracket with the ceramic bushing. This involves a single adhesive step for securing the heating element to the bushing and the bracket to the bushing. These two mechanical operations can be performed in two steps when the adhesive for mounting the heating element is applied at a different time than the adhesive for integrating the bracket with the ceramic housing. In accordance with the preferred embodiment of the present invention, the passage in the bushing has a cylindrical surface and the bracket has an arcuate portion extending longitudinally from the connector portion of the bracket so the arcuate portion is concentric and coterminous with the cylindrical surface. Indeed, a recess in the surface accommodates the arcuate portion of the mounting bracket.

The ceramic bushing has either a rectangular cross-section with the passage being cylindrical or is a circular cross-section with a cylindrical passage. The insulation material of the bushing is cast ceramic and the adhesive mass is a potting cement. This is standard material for fixing a cylindrical heating element to a ceramic mounting bushing. The bushing has a rear wall closing the element receiving passage with an opening in the rear wall for the input leads connected to the heating element. Furthermore, the front of the bushing has a slot intersecting the passage and, thus, allowing axial sliding insertion of the mounting bracket into the bushing. A single step application of the adhesive mass that integrates or fixedly joins the bushing and mounting bracket.

In accordance with still another aspect of the invention, there is provided a ceramic bushing for supporting a cylindrical heating element of a gas igniter. The bushing includes a cylindrical passage with an open front end for receiving the heating element. The passage has an arcuate recess terminating in a slot extending to the outside of the bushing from the passage. Through this clearance slot a sheet metal bracket is mounted in a given position. The bracket has a connector portion extending through the slot and an arcuate portion laying in the recess in an orientation concentric to the cylindrical passage.

The primary object of the present invention is the provision of a mounting device for a cylindrical heating element of a gas igniter, which mounting device performs the necessary features with a lesser amount of sheet metal in the bracket and requiring fewer mounting operations, so the gas igniter, when assembled, cost less than previous models.

Yet another object of the present invention is the provision of a mounting device, as defined above, which mounting device integrally forms the bracket with the mounting bushing of the gas igniter, so there is no assembly operation in the field and no surrounding bracket assembled to the bushing before shipment.

Still a further object of the present invention is the provision of a mounting device, as defined above, which mounting device involves integrally forming the mounting bracket to the ceramic bushing so there is no assembly operation or possibility of vibration release of the bracket from the bushing.

These and other objects and advantages will become apparent from the description taken together with the accompanying drawings.

PREFERRED EMBODIMENT

Figure 1:
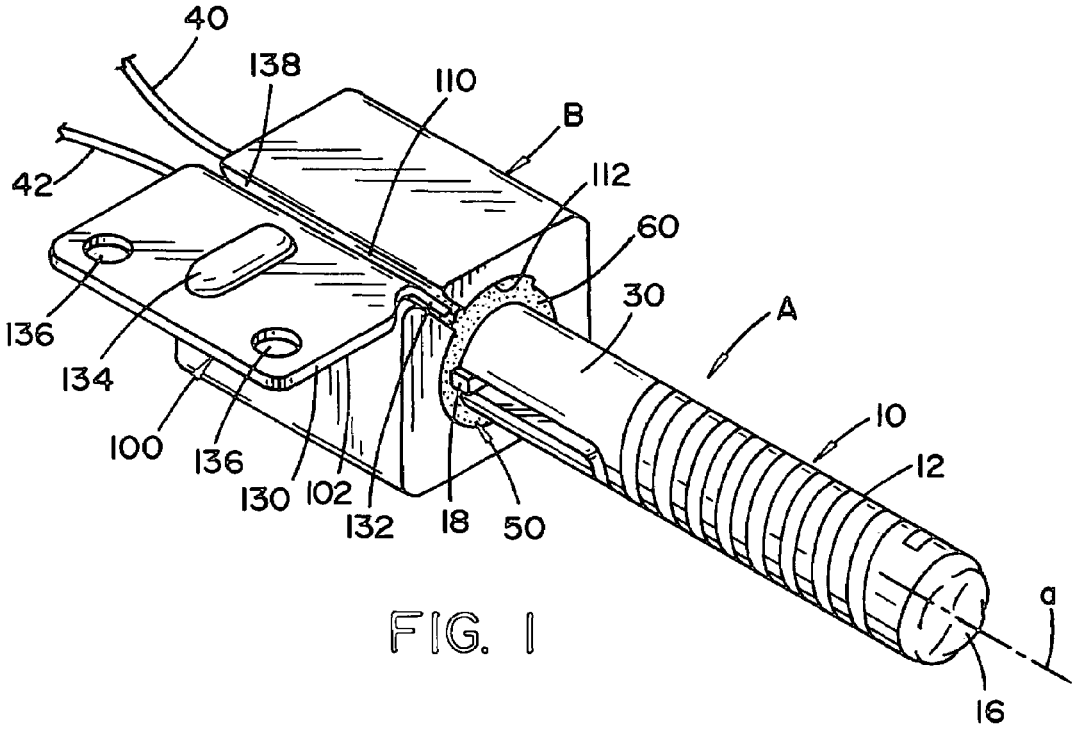
FIG. 1 is a pictorial view of the novel gas igniter.
Figure 3:
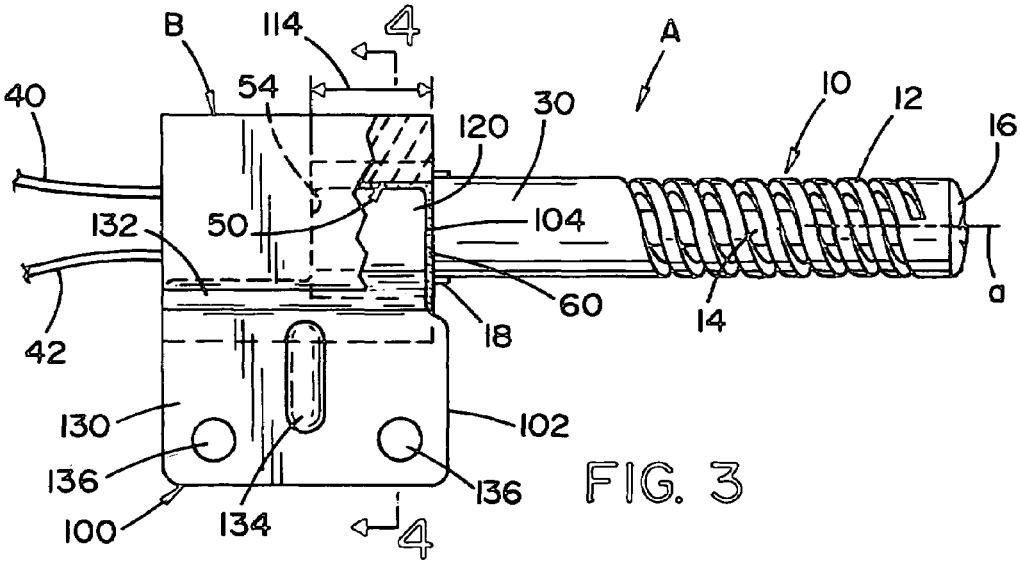
FIG. 3 is a top plan view, partially cross-sectioned, showing the novel gas igniter of FIG. 1.
Figure 2:
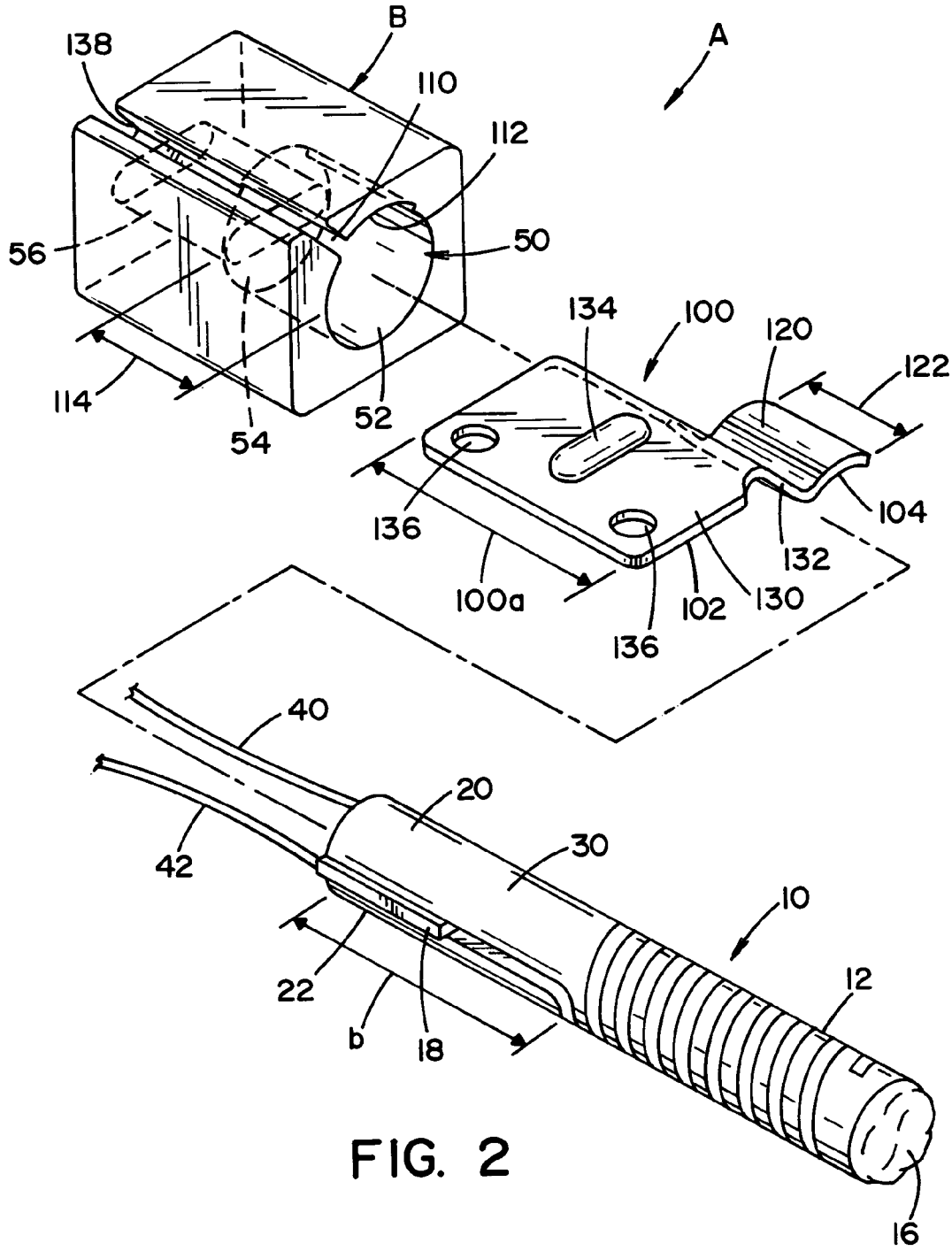
FIG. 2 is an exploded view of the gas igniter shown in FIG. 1.
Figure 4:
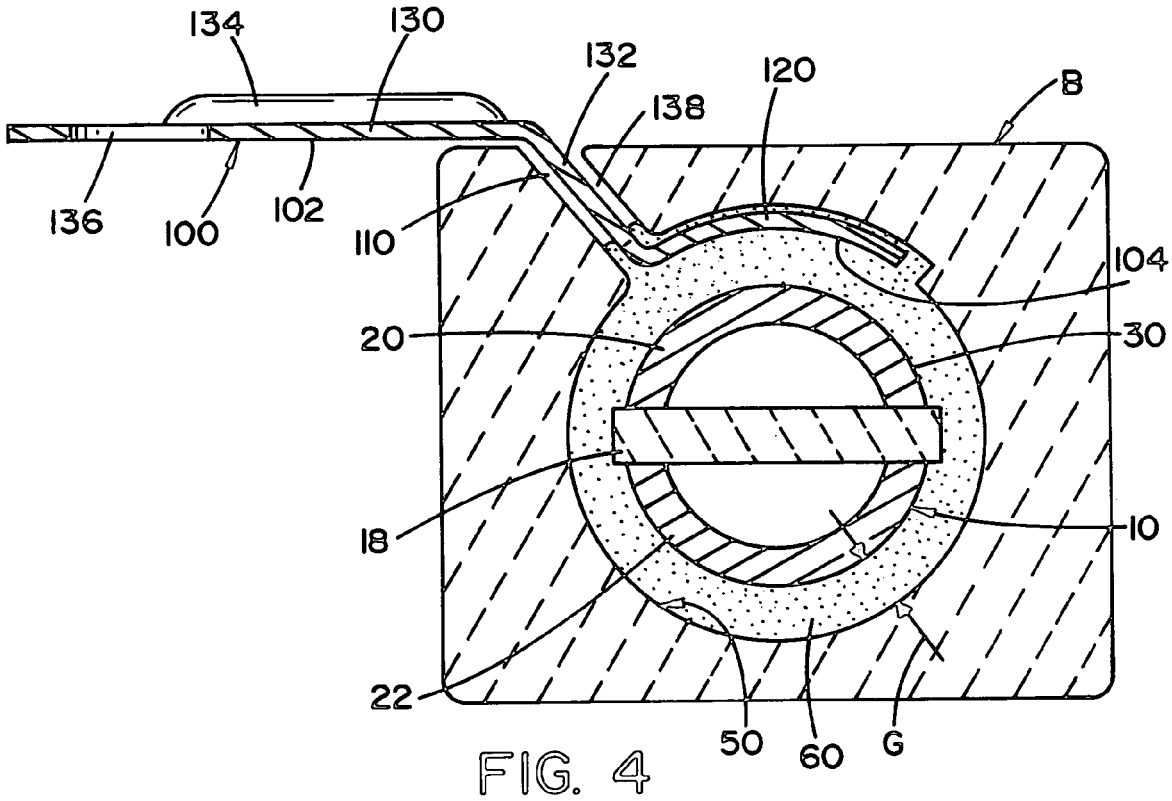
FIG. 4 is an enlarged cross-sectional view taken generally along line 4-4 of FIG. 3.
Figure 5:
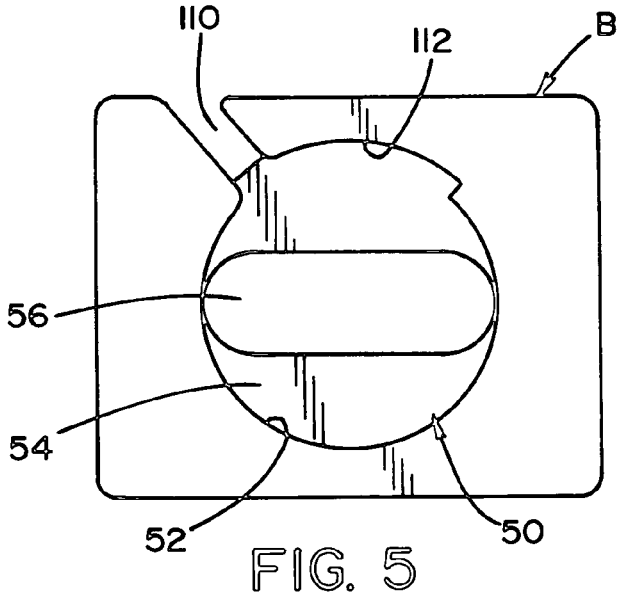
FIG. 5 is an enlarged front view of the novel bushing used in the igniter shown in FIG. 1.
Figure 6:
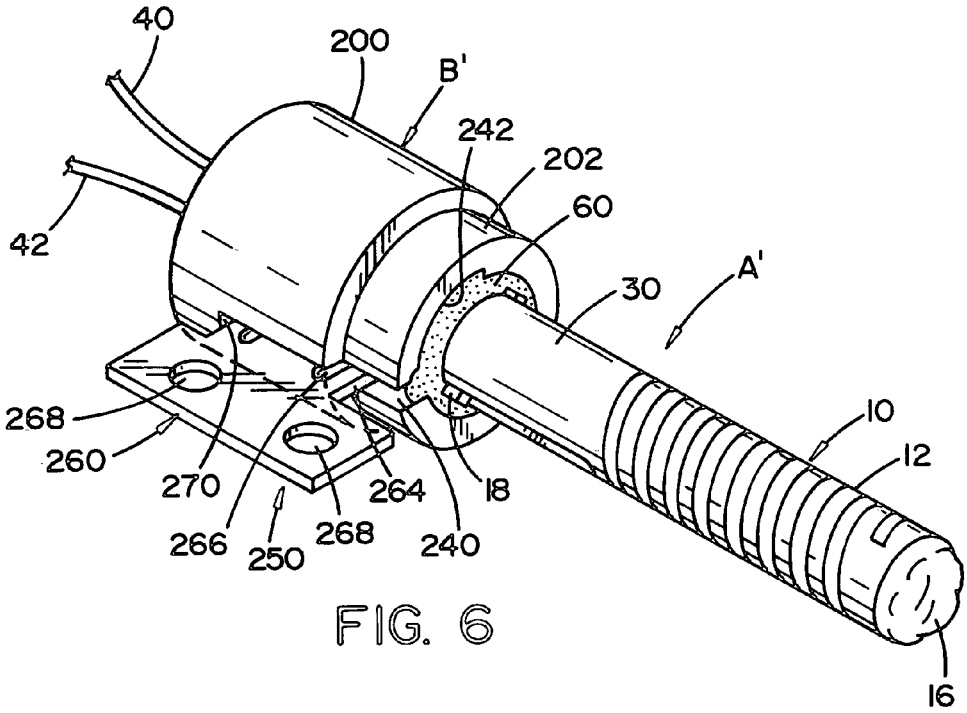
FIGS. 6, 7, 8, 9, and 10 are views similar to FIGS. 1, 2, 3, 4 and 5 for a second embodiment of the present invention.
Figure 8:
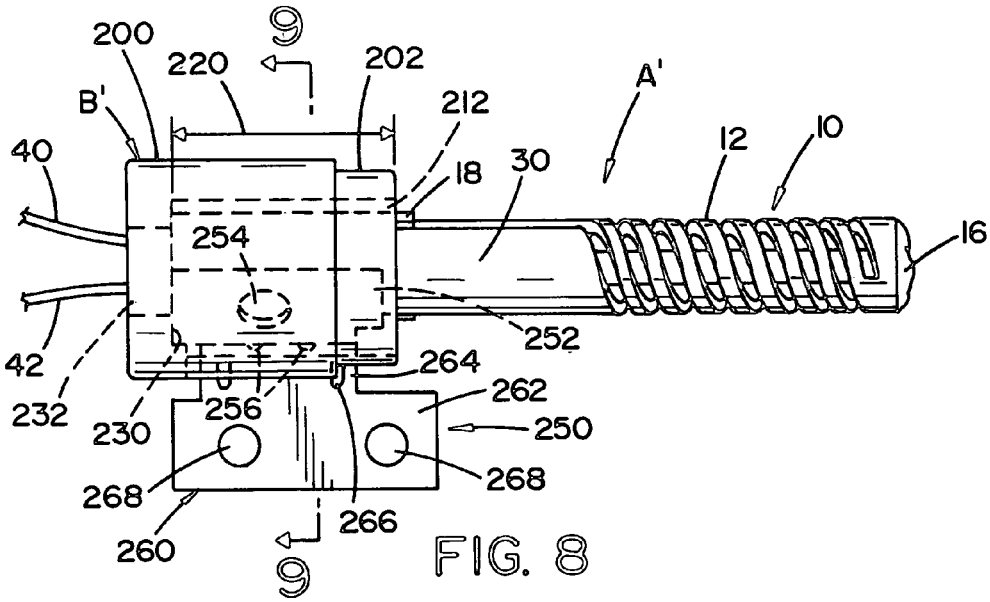
Figure 7:
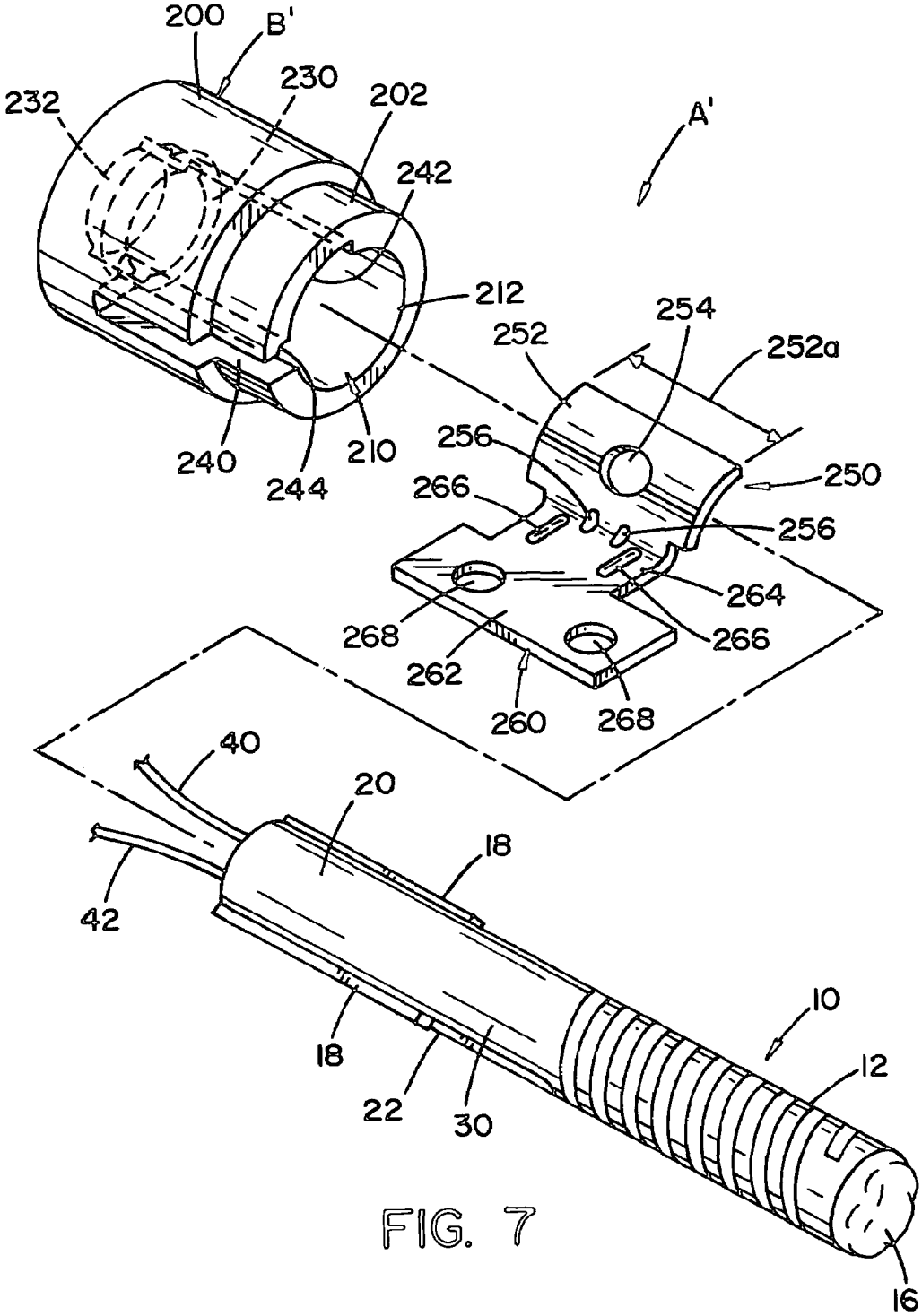
Figure 9:
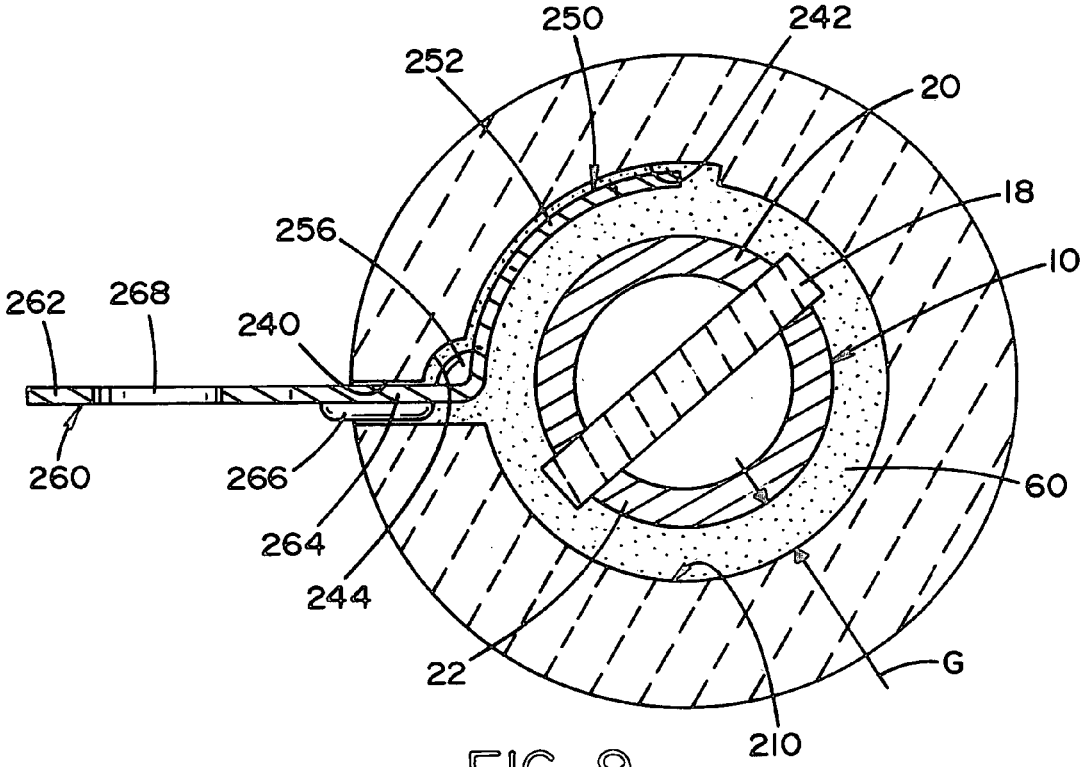
Figure 10:
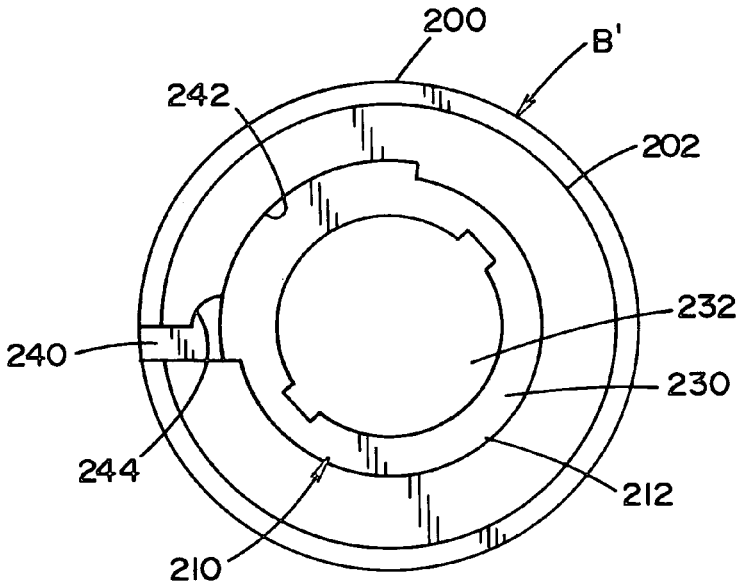

Gas igniter A, constructed in accordance with the preferred embodiment of the invention, is shown in FIGS. 1-5. The igniter is somewhat standard and is shown in several prior art patents incorporated by reference herein. A standard cylindrical heating element 10 has central axis a and includes cylindrical nose coil 12 formed of high resistance heating material with an inside insulation 14 affixed to the distal end of coil 12 by a tipping cement 16. At the rear portion of heating element 10 there is an insulation strip 18 separating rear terminal elements 20, 22, each having a projection length b to define generally rigid, cylindrical support section 30 so input leads 40, 42 can be connected to rear terminals 20, 22, respectively, to cause rapid heating of coil 12 for the purposes of igniting a gas in an appliance. The novel aspect of the invention is construction and use of ceramic bushing B for mounting igniter A onto an external support structure of the appliance, which structure is well known, but not shown. Bushing B is formed from a cast ceramic and includes a central passage 50 having an opened front end 52 and a rear wall 54 with a clearance opening 56 for input leads 40, 42. Adhesive mass 60 is an appropriate cement, such as No. 8 potting cement, and is used to fill gap G between passage 50 and support section 30 of heating element 10. Sheet metal mounting bracket 100 is integrally formed with bushing B and has a connector portion 102 and an arcuate portion 104 used for the integral bond with the inside of passage 50 in bushing B. The invention involves integrally forming bracket 100 with bushing B. In the preferred technique for this novel operation, bracket 100 is mounted in bushing B and heating element 10 is inserted into passage 50. Thereafter, potting cement mass 60 fills gap G and captures bracket 100 onto bushing B. In this preferred embodiment, ceramic bushing B is rectangular in cross-section, shown as a square cross-section, and includes axially extending slot 110 intersecting arcuate recess 112 in passage 50. Recess 112 and passage 50 have axial length 114 to capture and accommodate an arcuate tab 120 forming arcuate portion 104 of bracket 100. Tab 120 is captured by the same potting cement mass 60 as is used to fix heating element 10 in passage 50 of ceramic bushing B. Connector portion 102 of bracket 100 includes plate 130 having an axial length 100*a* with an angled strap 132 fitting into slot 110 and attached to tab 120. The tab matches arcuate recess 112. Strap 132 extends the total length of plate 130 and is subsequently locked into slot 110 by a separate potting material, not shown, deposited into groove 138. Plate 130 includes a reenforcing dimple or projection 134 and a number of mounting holes 136 for mounting bracket 100 onto an external support structure. The preferred embodiment as shown in FIGS. 1-5 is rectangular in cross-section and has a bracket 100 integrally formed with bushing B to support igniter A. In this manner, the amount of metal needed for bracket 100 is reduced and the assembly procedure for igniter A is simplified. This results in a cost reduction for material and labor. Since igniter A is mass produced, minor costs savings are major factors in the competitive market of this assembly.

A second embodiment of the invention is illustrated in FIGS. 6-10 wherein igniter A1' has a standard cylindrical heating element 10, but employs a cylindrical bushing B' to reduce the amount of cast ceramic required to practice the invention. The bushing includes a large cylindrical section 200 and a reduced front cylindrical section 202 concentric with central passage 210 for receiving heating element 10. The passage has a front opening 212 and an axial length 220 terminating in a back wall 230 with opening 232 for leads 40, 42. Passage 210 is intersected by angled slot 240 corresponding with slot 110 of the first embodiment. Assembly slot 240 terminates in arcuate recess 242 and has an axially extending cavity 244 for accommodating projections on bracket 250, which bracket is slid into slot 240 so arcuate portion 252 matches recess 242. Arcuate portion 252 has a width 252*a* slightly smaller than length 220 of passage 210. Bracket 250 is moved axially through slot 240 so arcuate portion 252 rests in arcuate recess 242 to form gap G filled by potting cement mass 60 as in the preferred embodiment of the invention. In this second embodiment arcuate portion 252 has hole 254 that is embedded with the adhesive mass during filling of gap G to increase the strength of the integration of the bracket and bushing. At the angle between arcuate portion 252 and connector portion 260, the bracket includes reenforcing projection 256 that requires clearance cavity 244 of slot 240. To increase the integral bond between the bracket and bushing of the first embodiment a similar hole 254 could be provided in arcuate tab 120. Connector portion 260 includes plate 262 with a reduced extension 264 joining the connector portion to arcuate portion 252. As in the first embodiment, plate 262 includes reenforcing projection 266 and mounting holes 268. To finalize assembly of igniter A', cavity 270 can be filled with a second potting mass even though this is not required. This embodiment of the invention reduces the amount of ceramic required for bushing B' and does not substantially increase the amount of metal or labor costs for the igniter.

Figure 11:
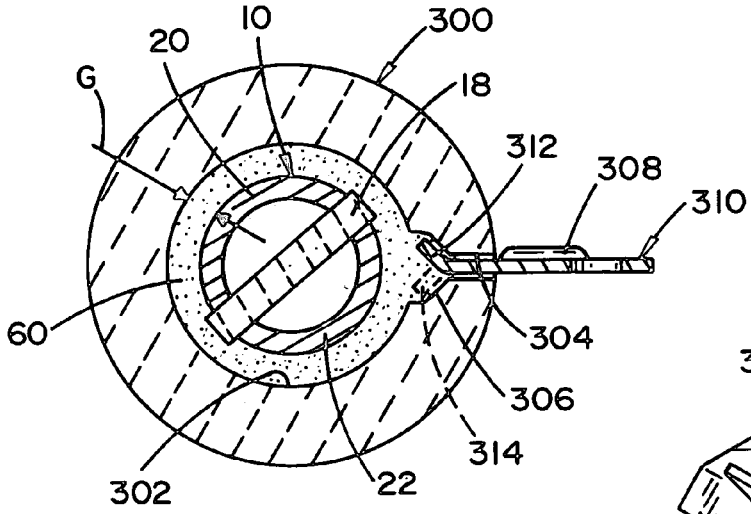
FIG. 11 is a cross-sectional view of a third embodiment of the present invention.
Figure 12:
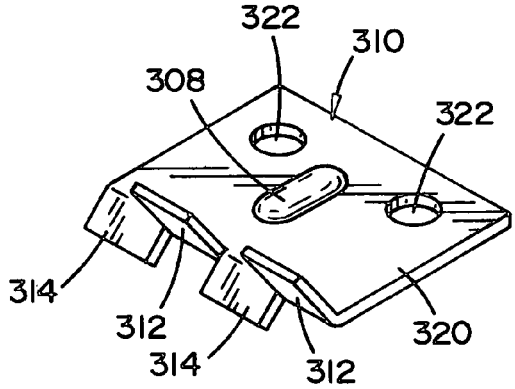
FIG. 12 is a pictorial view of the mounting bracket used in the embodiment of FIG. 11; and, FIG. 13 is a cross-sectional view of still a further embodiment of the present invention.

The novel feature of integrally forming the ceramic bushing and mounting bracket for an igniter can be performed in many configurations using different techniques To illustrate the breadth of this invention, a further igniter is illustrated in FIGS. 11 and 12. Bushing 300 includes a central cylindrical passage 302 with an intersecting slot 304 and cavity 306 projecting from gap G. Bracket 310 having oppositely angled tabs 312, 314 is slid into slot 304 with tabs 312, 314 fixed in cavity 306. Reenforcing projection 308 locates tabs 312, 314 in cavity 306 so that the potting cement filling gap G locks bracket 310 into the position with connector portion 320 extending outwardly for attachment to an external support structure.

Figure 13:
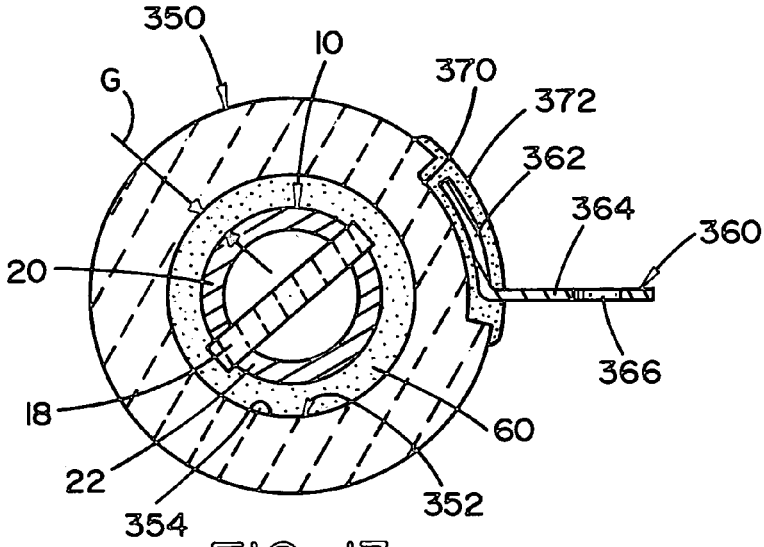

Although it is preferred that the bracket extends into the ceramic bushing for integrally forming these two components, it is within the scope of the invention to integrally form the ceramic bushing and mounting bracket on the outside portion of the bushing. This is schematically illustrated in FIG. 13 wherein cylindrical bushing 350 has an internal support passage 352 defining a cylindrical surface 354 for creating gap G filled with potting cement 60 as previously described. Bracket 360 has an arcuate portion 362 and connector portion 364 with appropriate mounting holes 366. To integrally form the bushing and bracket, the outer surface of bushing 350 includes cavity 370 having an arcuate shape conforming to arcuate portion 362 of bracket 360. Cement 372 integrally forms bracket 360 with bushing 350. Other such external mounting arrangements could be used in practicing the present invention.

Having thus defined the invention is claimed:

1. A ceramic bushing for supporting a cylindrical heating element of a gas igniter, said bushing including a cylindrical passage extending into said bushing, said passage having an open front end for receiving said heating element, said passage further including an inwardly facing arcuate recess terminating in a slot and said slot extending from said passage to an outer surface of said bushing, said bushing further including a sheet metal bracket extending from said passage through said slot and adapted to mount in a given position, said sheet metal bracket including a connector portion extending through said slot and an arcuate portion laying in said inwardly facing recess in an orientation concentric with said cylindrical passage when in said given position.

2. A bushing as defined in claim 1 and having an access slot intersecting said clearance slot to allow said sheet metal bracket to slide axially into said passage into said given position.

3. bushing as defined in claim 2 wherein said passage has a diameter greater than the diameter of said heating element to define a gap including said recess so an adhesive can fill said gap to fix said bushing and bracket into an integrated structure and lock said heating element in said bushing.

4. bushing as defined in claim 1 wherein said passage has a diameter greater than the diameter of said heating element to define a gap including said recess so an adhesive can fill said gap to fix said bushing and bracket into an integrated structure and lock said heating element in said bushing.

5. A bushing as defined in claim 4 wherein said adhesive is a potting cement.

6. A bushing as defined in claim 1 wherein said arcuate portion extends outwardly from said connector portion with said arcuate portion concentric and coterminous with said cylindrical surface.

7. A bushing as defined in claim 1 wherein said passage is generally concentric with the cross-section of said bushing.

8. A bushing as defined in claim 1 wherein said bushing is cast ceramic.

9. A bushing as defined in claim 1 wherein said bushing has a back wall closing said passage and having an opening for electrical leads.

10. A bushing as defined in claim 1 wherein said arcuate portion includes an opening to be embedded by said adhesive mass.

11. A bushing as defined in claim 1 wherein the intersection of said arcuate portion and said connector portion is at an angle and includes reinforcing projections.

12. A ceramic bushing for supporting a cylindrical heating element of a gas igniter, said bushing having a front and a back with at least one side extending between said front and said back, said bushing further including an inner passage extending inwardly from said front and said passage being shaped to receive an associated heating element, said passage having an inwardly facing recess with a slot extending from said recess in said passage to an exterior of said bushing on said at least one side; a sheet metal bracket having a connector portion and a tab portion, said inwardly facing recess being shaped to receive said tab portion such that said bracket extends through said slot and said tab is in said recess and said connector portion is in said slot when in a operable position.

* * * * *